US007501950B2

(12) United States Patent
Suzuki

(10) Patent No.: US 7,501,950 B2
(45) Date of Patent: Mar. 10, 2009

(54) RFID TAG RECOGNITION APPARATUS AND METHOD AND ARTICLE SALES DATA PROCESSING APPARATUS

(75) Inventor: Shigeaki Suzuki, Izu (JP)

(73) Assignee: Toshiba Tec Kabushiki Kaisha (JP)

( * ) Notice: Subject to any disclaimer, the term of this patent is extended or adjusted under 35 U.S.C. 154(b) by 313 days.

(21) Appl. No.: 11/449,790

(22) Filed: Jun. 8, 2006

(65) Prior Publication Data

US 2007/0008136 A1 Jan. 11, 2007

(30) Foreign Application Priority Data

Jun. 17, 2005 (JP) ..... 2005-177955

(51) Int. Cl.
*G08B 13/14* (2006.01)

(52) U.S. Cl. ..... 340/572.1; 340/10.1; 235/375

(58) Field of Classification Search ... 340/572.1–572.9, 340/10.1–10.6, 5.61; 235/375–385, 492; 705/22–24, 28–32; 700/215, 221–222, 224–227, 700/229

See application file for complete search history.

(56) References Cited

U.S. PATENT DOCUMENTS

| | | | | |
|---|---|---|---|---|
| 5,546,475 | A * | 8/1996 | Bolle et al. | 382/190 |
| 5,609,223 | A * | 3/1997 | Iizaka et al. | 186/61 |
| 6,809,645 | B1 * | 10/2004 | Mason | 340/572.1 |
| 7,100,052 | B2 * | 8/2006 | Ghazarian | 713/182 |
| 7,232,067 | B1 * | 6/2007 | Bromer | 235/385 |
| 2002/0011933 | A1 * | 1/2002 | Andersen et al. | 340/572.1 |
| 2005/0263592 | A1 * | 12/2005 | Berger et al. | 235/385 |
| 2006/0038077 | A1 * | 2/2006 | Olin et al. | 244/137.1 |
| 2006/0094399 | A1 * | 5/2006 | Dupont | 455/410 |
| 2006/0187041 | A1 * | 8/2006 | Olsen et al. | 340/572.1 |

FOREIGN PATENT DOCUMENTS

| | | |
|---|---|---|
| DE | 103 23 691 A1 | 12/2004 |
| EP | 1 248 244 A2 | 10/2002 |
| JP | 10-049756 | 2/1996 |
| JP | 2004-102563 | 9/2002 |
| WO | WO 00/67221 | 11/2000 |

* cited by examiner

*Primary Examiner*—George A Bugg
(74) *Attorney, Agent, or Firm*—Harness, Dickey & Pierce, P.L.C.

(57) ABSTRACT

An RFID tag recognizing portion reads information from a plurality of RFID tags lying in a communication area of an antenna. The number of RFID tags from which information is read is counted. Further, the number of articles lying in the communication area of the antenna is acquired. Then, the number of RFID tags 6*a* is compared with the number of articles and information of the RFID tags is determined when they coincide with each other.

13 Claims, 7 Drawing Sheets

RFID TAG RECOGNITION APPARATUS AND METHOD AND ARTICLE SALES DATA PROCESSING APPARATUS

CROSS-REFERENCE TO RELATED APPLICATIONS

This application is based upon and claims the benefit of priority from prior Japanese Patent Application No. 2005-177955, filed Jun. 17, 2005, the entire contents of which are incorporated herein by reference.

BACKGROUND OF THE INVENTION

1. Field of the Invention

This invention relates to an apparatus and method which recognize information stored in a radio frequency identification (RFID) tag by use of radio communication and an article sales data processing apparatus which processes article sales data based on information stored in the RFID tag.

2. Description of the Related Art

In recent years, as a non-contact type article recognition system utilizing electromagnetic waves, a system using RFID tags has been developed. Basically, the system is configured by RFID tags, an RFID tag reader and an information processing apparatus. The RFID tags are respectively attached to articles to be recognized. The RFID tag reader reads storage information items of the RFID tags attached to the respective articles by use of radio waves. The information processing apparatus recognizes an article to which the RFID tag is attached based on information read by the RFID tag reader.

For example, the article recognition system using RFID tags is used for a check out system in a supermarket or the like. One example of the system is disclosed in Jpn. Pat. Appln. KOKAI Publication No. H10-049756.

The RFID tag is attached to each article. In the memory of the RFID tag, article information such as an identification code of an article to which the tag is attached is stored. The RFID tag reader is provided on an article placing portion on which articles to be purchased by customers are placed. Therefore, if articles to be purchased by customers are placed on the article placing portion, article information items of the RFID tags attached to the respective articles are read by the RFID tag reader.

An information processing apparatus is connected to the RFID tag reader. The information processing apparatus recognizes an article to be purchased by a customer according to article information of the RFID tag read by the RFID tag reader. Then, it performs the settlement process for the articles.

Further, this type of article recognition system is utilized for a check out system in a self-service type dining hall. One type of this system is disclosed in Jpn. Pat. Appln. KOKAI Publication No. 2004-102563.

The RFID tag is attached to each, bowl, cup, dish or the like (in this specification, a dish is used as a representative). In the memory of the RFID tags, information items of menu articles to be served in dishes to which the RFID tags are attached are stored. The RFID tag reader is provided on a tray placing portion on which a tray is placed. The user places dishes of menu articles ordered on a tray and then places the tray on the tray placing portion. Thus, the menu article information items of the RFID tags attached to the dishes on the tray are read by the RFID tag reader.

An information processing apparatus is connected to the RFID tag reader. The information processing apparatus recognizes menu articles of food which the user will eat or drink according to the menu article information items of the RFID tags read by the RFID tag reader. Then, it performs the settlement process for the menu articles.

In the above article recognition system, a function of anti-collision is used. The function of anti-collision is a control function of simultaneously reading storage information items of the RFID tags when a plurality of RFID tags are present in the communication area of one antenna of the RFID tag reader.

However, the RFID tag reader cannot always communicate with all of the RFID tags present in a communicable range of the antenna. There occurs a possibility that an RFID tag cannot communicate due to superposition of RFID tags, influence by noise or the like. Further, there occurs a possibility that an RFID tag is damaged.

Conventionally, when an RFID tag which could not communicate with the RFID tag reader was present, the information processing apparatus could not recognize the storage information of the RFID tag. However, the information processing apparatus determined the information sent from the RFID reader. Therefore, the operator of the information processing apparatus was required to determine whether storage information items of the RFID tags attached to all of the to-be-recognized articles could be recognized or not.

BRIEF SUMMARY OF THE INVENTION

An object of this invention is to enhance the operability and reliability of the tag recognition operation.

According to one aspect of this invention, there is provided an RFID tag recognition apparatus comprising an antenna which radio-communicates with RFID tags, a reading portion which reads storage information of RFID tags present in a communicable area of the antenna, a tag counting portion which counts the number of RFID tags from which storage information is read by the reading portion, an article number acquiring portion which acquires the number of articles present in the communicable area of the antenna, a comparator portion which compares the number of articles acquired by the article number acquiring portion with the number of RFID tags counted by the tag counting portion, and a processing portion which performs a process according to the comparison result by the comparator portion.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

There will now be described a preferable embodiment of this invention with reference to the accompanying drawings. The present embodiment indicates a case wherein this invention is applied to a check out system in a self-service type dining hall.

Figure 1:
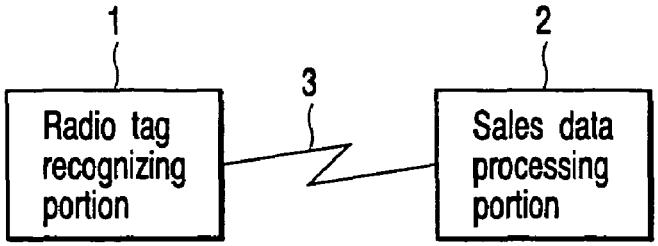
FIG. 1 is a schematic diagram showing the schematic configuration of an article sales data processing apparatus according to one embodiment of this invention.

FIG. 1 is a block diagram showing the schematic configuration of an article sales data processing apparatus according to the present embodiment. The present apparatus is configured by an RFID tag recognizing portion 1 and sales data processing portion 2. In the RFID tag recognizing portion 1, menu articles which the user orders are specified based on menu article information of RFID tags attached to dishes or the like placed on a tray. In the sales data processing portion 2, the sales data of the menu articles specified by the RFID tag recognizing portion 1 are processed. A general point-of-sales (POS) terminal is used as the sales data processing portion 2.

The RFID tag recognizing portion 1 is connected to the sales data processing portion 2 via a communication line 3. The communication line 3 may be realized by use of a wire or by radio. Further, a unit obtained by integrally forming the RFID tag recognizing portion 1 and sales data processing portion 2 can be used.

Figure 2:
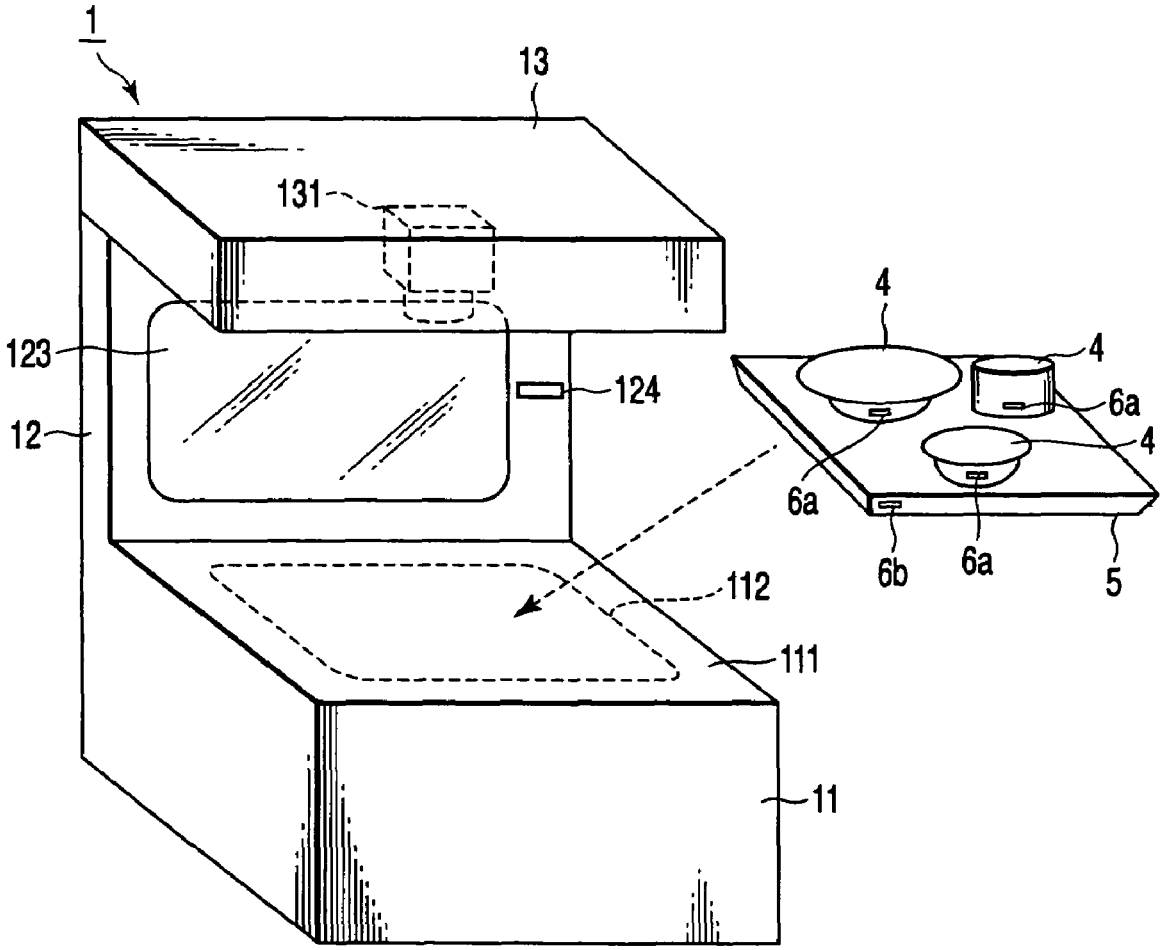
FIG. 2 is an external view of an RFID tag recognizing portion in the article sales data processing apparatus.
Figure 3:
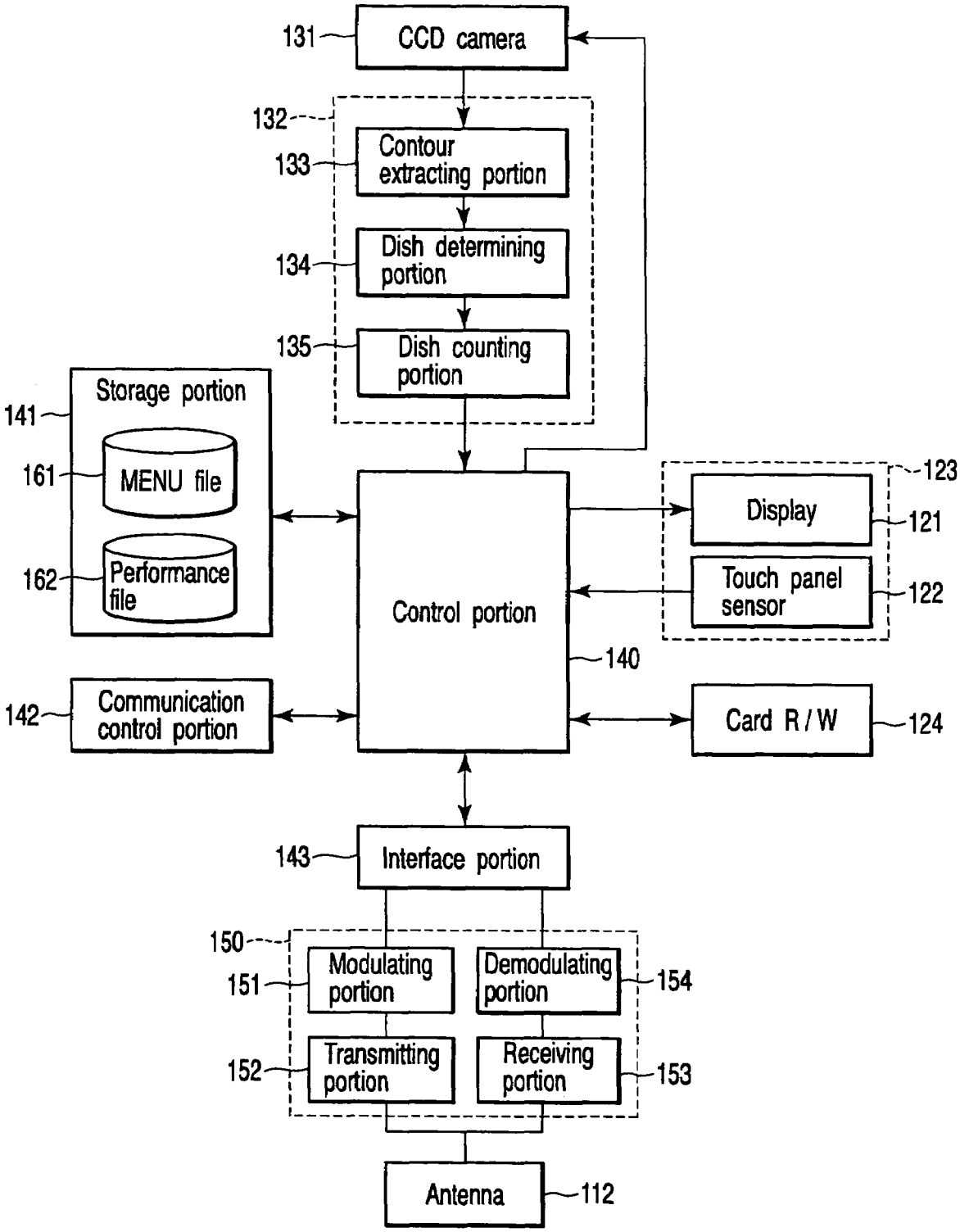
FIG. 3 is a block diagram showing the main configuration of the RFID tag recognizing portion.

Next, the hardware configuration of the RFID tag recognizing portion 1 is explained by use of the external view of FIG. 2 and the block diagram of FIG. 3. The RFID tag recognizing portion 1 includes an antenna portion 11, operation display portion 12 and photographing portion 13.

In the antenna portion 11, a tray plate 111 on which a tray 5 used to have dishes 4 placed thereon can be placed is formed. In the tray plate 111, an antenna 112 for communication with RFID tags is buried. The antenna 112 transmits inquiry waves upward of the dishes 4 with respect to RFID tags 6. Further, the antenna 112 receives response waves transmitted from the RFID tags 6 which have received the inquiry waves and are activated.

The RFID tag 6 is attached for each of the dishes 4 and tray 5. In the present embodiment, for easy understanding of the explanation, the RFID tag 6 attached to the dish 4 is referred to as a dish tag 6*a* and the RFID tag 6 attached to the tray 5 is referred to as a tray tag 6*b*.

Figure 4:
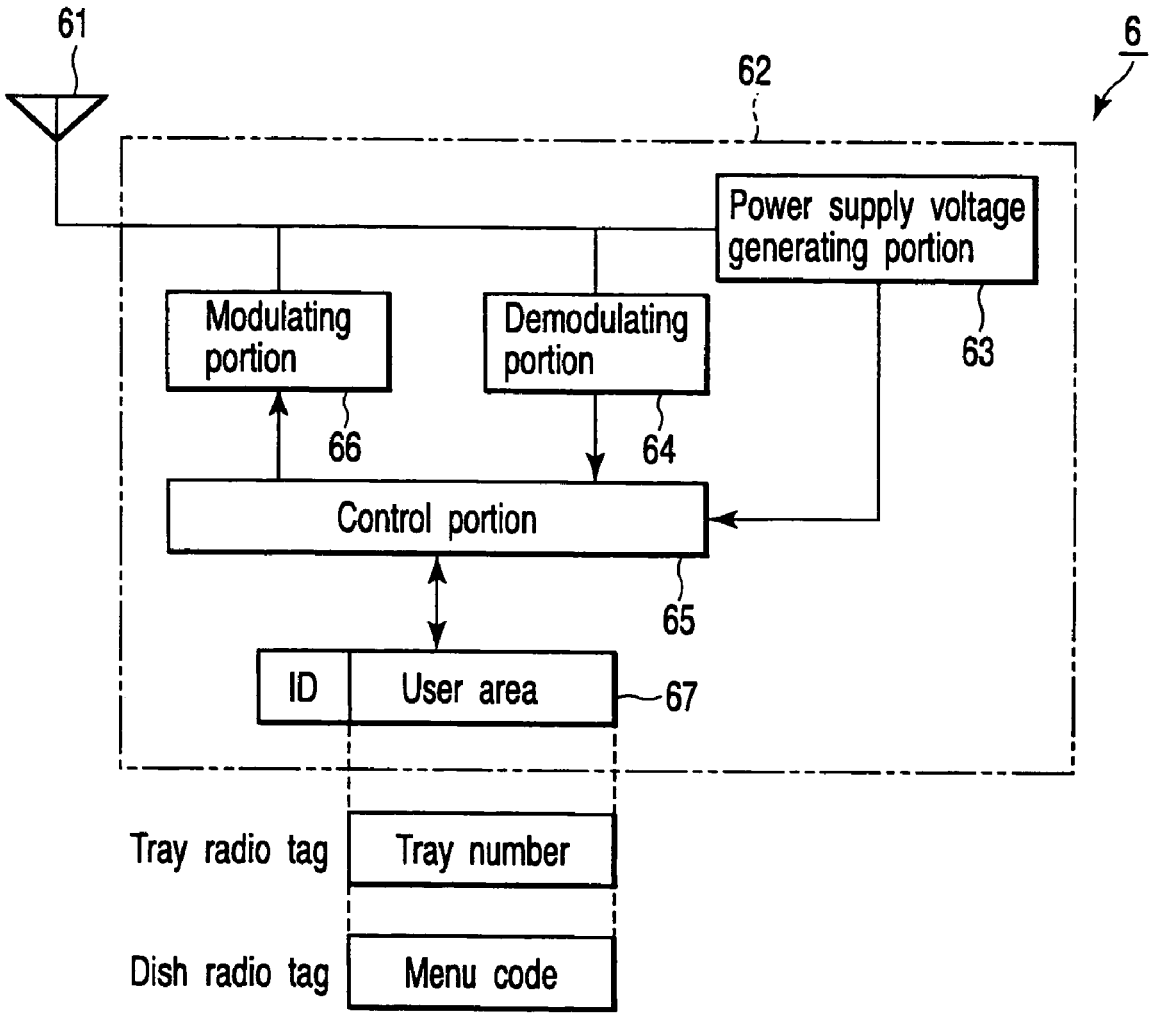
FIG. 4 is a block diagram showing the main configuration of the RFID tag used in the present embodiment.

The configuration of the RFID tag 6 is explained with reference to the block diagram of FIG. 4.

The RFID tag 6 is configured by an antenna 61 and IC chip 62. In the IC chip 62, a power supply voltage generating portion 63, demodulating portion 64, control portion 65, modulating portion 66 and nonvolatile memory 67 are provided. The power supply voltage generating portion 63 generates power supply voltages by rectifying and stabilizing a modulated wave received by the antenna 61 and supply the same to the respective portions of IC chip 62. The demodulating portion 64 demodulates the modulated wave and supply the demodulated wave to the control portion 65. The modulating portion 66 modulates data transmitted from the control portion 65 and supplies the modulated data to the antenna 61. The control portion 65 writes data demodulated by the demodulating portion 64 into the memory 67. Further, it reads out data from the memory 67 and supplies the readout data to the modulating portion 66.

In the memory 67, an inherent ID set by the manufacturer at the manufacturing stage of the RFID tag 6 is previously stored. Further, a user area in which the user can freely write data is provided. In the user area of the tray RFID tag 6*b*, an inherent tray number previously set for the tray to which the tag is attached is written. In the user area of the dish RFID tag 6*a*, a menu code of a menu article served in a dish to which the tag is attached is written.

Now, the RFID tag recognizing portion 1 is explained. On the operation display portion 12, a touch panel 123 and card reader/writer 124 are provided. The touch panel 123 is configured by a display 121 and touch panel sensor 122. The card reader/write 124 performs the read/write operation with respect to a settlement card.

The settlement card is an IC card which each user utilizing the dining hall carries. In the memory portion of the settlement card, at least user ID used to identify a user and remaining amount data used to pay various types of charges are recorded. The remaining amount data can be adequately increased by use of an exclusive depositing device. A prepaid card whose remaining amount data cannot be increased may be used as the settlement card.

The photographing portion 13 has a CCD camera 131 mounted thereon. The CCD camera 131 photographs the entire area of the tray 5 placed on the tray plate 111. Image data photographed by the CCD camera 131 is processed by an image processing portion 132.

The image processing portion 132 includes a contour extracting portion 133, dish determining portion 134 and dish counting portion 135. The contour extracting portion 133 extracts the contour of an article based on the image data. The dish determining portion 134 determines a dish 4 based on the contour of the article. The dish counting portion 135 counts the number of dishes determined. The dish RFID tag 6*a* is attached to each of the dishes 4. Therefore, generally, the number of dishes counted by the dish counting portion 135 coincides with the number of dish RFID tags 6*a* lying in the communication area of the antenna 112.

Data of the number of dishes counted by the dish counting portion 135 is input to a control portion 140 which is mainly configured by a CPU. The control portion 140 is connected to the touch panel 123, card reader/writer 124, CCD camera 131, storage portion 141 such as an HDD device, communication control portion 142, interface portion 143 with an RFID tag reader 150 and the like. The sales data processing portion 2 is connected thereto via the communication control portion 142.

The RFID tag reader 150 includes a modulating portion 151, transmitting portion 152, receiving portion 153 and demodulating portion 155. The modulating portion 151 modulates a data signal from the control portion 140. The transmitting portion 152 amplifies modulated waves and transmits the same from the antenna 112. The receiving portion 153 amplifies radio waves transmitted from the RFID tag 6 and received by the antenna 112 and fetches the same. The demodulating portion 155 demodulates radio waves amplified by the receiving portion 153 into a data signal and supplies the data signal to the control portion 140.

A menu file 161 and performance file 162 are stored in the storage portion 141. In the menu file 161, menu information such as an article name, price and the like is held in correspondence to a menu code set for each menu article. In the performance file 162, data of utilization performance of the dining hall is held for each user.

Figure 5:
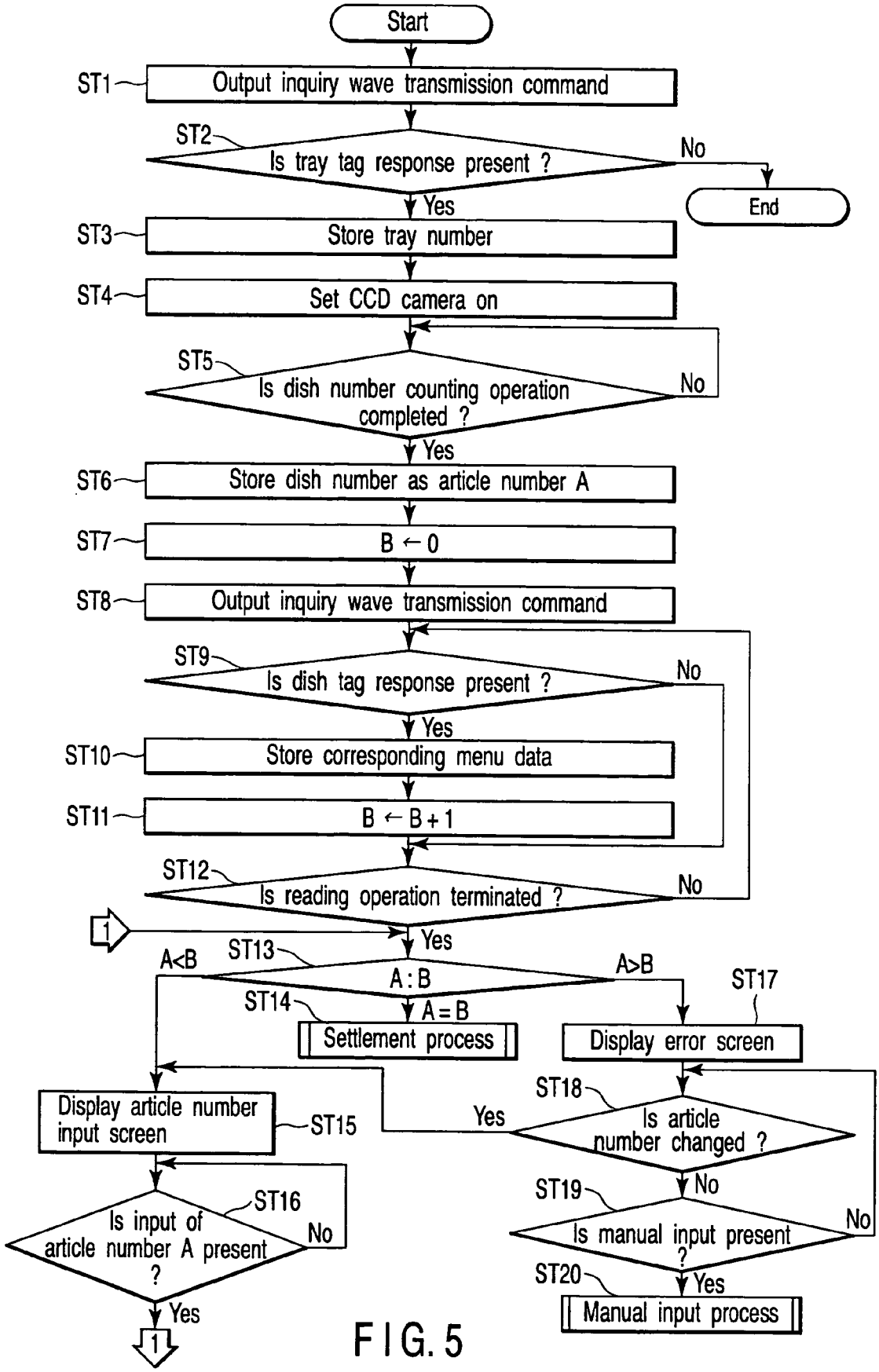
FIG. 5 is a flowchart for illustrating the main portion of a control processing procedure executed by the control portion of the RFID tag recognizing portion.

Next, the software configuration of the RFID tag recognizing portion 1 is explained with reference to the flowchart of FIGS. 5 to 7 and the display screen examples of FIGS. 8 to 10.

First, the control portion 140 outputs a transmission command of inquiry waves with respect to the RFID tag 6 to the interface 143 in step ST1. The transmission command is modulated in the modulating portion 151, amplified in the transmitting portion 152 and then transmitted as inquiry waves from the antenna 112. At this time, if an RFID tag 6 is present in the communication area of the antenna 112, the RFID tag 6 is activated.

Data stored in the memory 67 is generated from the activated RFID tag 6 as response waves. The response waves are received by the antenna 112. The response waves received by the antenna 112 are amplified by the receiving portion 153, modulated into data in the demodulating portion 154 and then supplied to the control portion 140 via the interface 143.

Thus, the RFID tag recognizing portion 1 fetches data of the RFID tag 6 lying in the communication area of the antenna 112. In the RFID tag recognizing portion 1, the anti-collision function is effectively performed. Therefore, when a plurality of RFID tags 6 are present in the communication area of the antenna 112, data items of the tags are fetched together.

The control portion 140 checks whether or not data of the tray RFID tag 6*b* is present in the simultaneously fetched data items in step ST2. When the tray 5 is placed on the tray plate 111, generally, data of the tray RFID tag 6*b* is fetched. When detecting data of the tray RFID tag 6*b*, the control portion 140 temporarily stores the tray number contained in data of the tray RFID tag 6*b* into the work area in step ST3.

Next, the control portion 140 outputs a photographing-on signal to the CCD camera 131 in step ST4. The CCD camera 131 performs the photographing operation in response to the photographing-on signal. Image data photographed by the CCD camera 131 is processed by the image processing portion 132. Thus, the number of dishes 4 on the tray 5 placed on the tray plate 111 is connted.

If the number of dishes 4 is counted by the image processing portion 132 in step ST5, the control portion 140 stores the number of dishes 4 as article number data A into the work area in step ST6.

The control portion 140 resets the addition counter B to zero in step ST7. Next, the control portion 140 outputs the transmission command of inquiry waves with respect to the RFID tag 6 to the interface 143 again in step ST8. Then, it waits in step ST9 until data of the dish RFID tag 6*a* is read. When a dish 4 is set on the tray 5 placed on the tray plate 111, generally, data of the dish RFID tag 6*a* is read.

Each time data of the dish RFID tag 6*a* is read, the control portion 140 retrieves the menu file 161 by use of a menu code contained in the data in step ST10. Then, it reads out menu data such as the menu name, price and the like and stores the readout data into the work area. Further, the control portion 140 counts up the addition counter B by "1" in step ST11 each time data of the dish RFID tag 6*a* is read. Therefore, the count of the addition counter B coincides with the number of dish RFID tags 6*a* from which data is read.

The control portion 140 waits in step ST12 until the read operation of the dish RFID tag 6*a* is terminated. When the read operation is terminated, the control portion 140 compares the count of the addition counter B with the article number data A in step ST13. That is, it compares the number A of dishes 4 detected based on the image photographed by the CCD camera 131 with the number B of dish RFID tags 6*a* from which information is read by the RFID tag reader 150.

As a result, if the number A coincides with the number B, the control portion 140 determines that information of the dish RFID tags 6*a* attached to all of the dishes 4 placed on the tray 5 could be correctly read. In this case, the control portion 140 performs the settlement process which will be described later in step ST14.

If the number B is larger than the number A, the control portion 140 recognizes that an error occurs in the number A of dishes 4 derived by the image process. In this case, the control portion 140 causes the display 121 to display an article number input screen 70 in step ST15.

Figure 8:
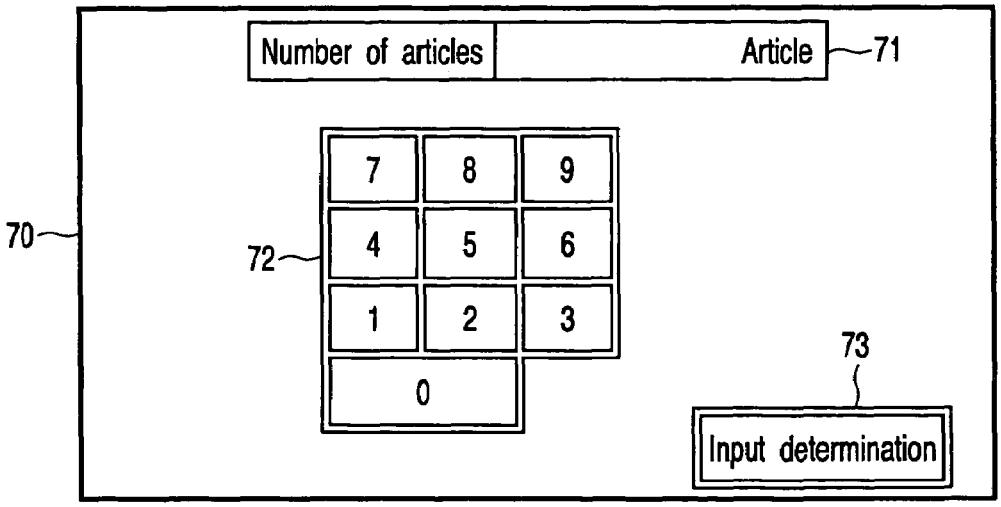
FIG. 8 is a view showing one example of an article number input screen displayed on a display of the RFID tag recognizing portion.

One example of the article number input screen 70 is shown in FIG. 8. On the article number input screen 70, a box 71 which displays the number of articles input, a numeric keypad 72 used as a numerical data input portion to input an article number and an input determination key 73 are displayed.

When the article number input screen 70 is displayed, the user inputs the number of dishes 4 placed on the tray 5 by use of the numeric keypad 72 and then depresses the input determination key 73.

The control portion 140 waits in step ST16 until the article number A is input. If numerical data is input by the operation of the numeric keypad 72, the control portion 140 causes the numerical data to be displayed in the box 71. Then, if the input determination key 73 is operated, the control portion 140 fetches the numerical data as the article number data A.

Next, the control portion 140 compares the article number data A with the count of the addition counter B. That is, it compares the number A of dishes 4 input via the numerical data input portion with the number B of dish RFID tags 6*a* from which information is read by the RFID tag reader 150. As a result, if the number A coincides with the number B, the control portion 140 performs the settlement process.

If the number B is smaller than the number A, the control portion 140 recognizes that tag information could not be correctly read. Such a phenomenon occurs when the dish RFID tag 6*a* is damaged, the dish RFID tags are superposed or the like. In this case, the control portion 140 causes the display 121 to display a tag read error screen 80 in step ST17.

Figure 9:
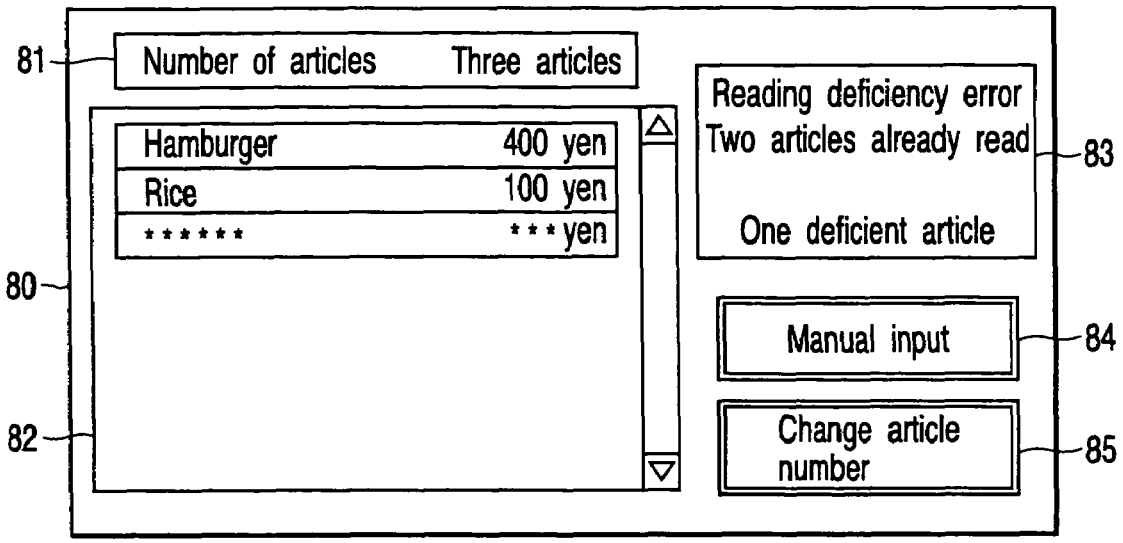
FIG. 9 is a view showing one example of a tag reading error screen displayed on the display of the RFID tag recognizing portion.
Figure 10:
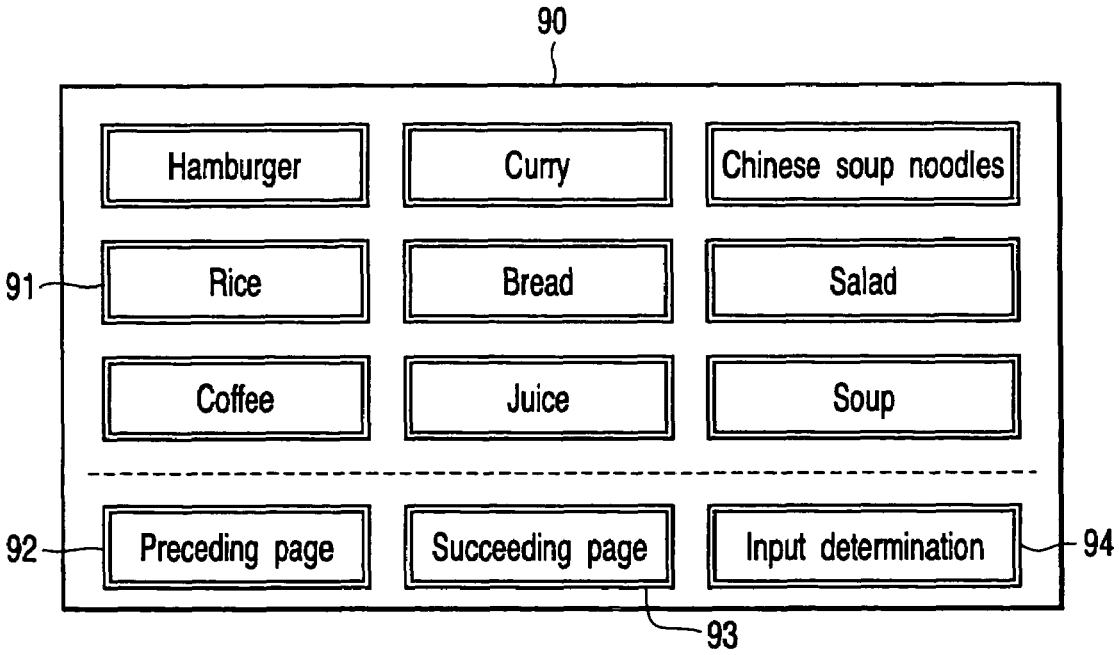
FIG. 10 is a view showing one example of a manual input screen displayed on the display of the RFID tag recognizing portion.

One example of the tag read error screen 80 is shown in FIG. 9. On the tag read error screen 80, display boxes 81, 82, 83, manual input key 84 and article number changing key 85 are displayed. In the display box 81, the number of dishes 4 is displayed as the number of articles. In the display box 82, a list of menu names and prices corresponding to the menu codes read from the dish RFID tags 6*a* is displayed. In the display box 82, a portion corresponding to an insufficient number with respect to the article number A is made vacant. In the display box 83, the number of articles which cannot be sufficiently read or the like is displayed.

When the tag read error screen 80 is displayed, the user can specify the dishes 4 in which the dish RFID tags 6*a* could not be read based on the contents of the boxes 81 to 83. In this case, the user operates the manual input key 74. Further, when it is determined that the number A of dishes is smaller based on the contents displayed on the display box 81, the user operates the article number changing key 75.

The control portion 140 waits until the article number changing key 75 or manual input key 74 is operated. When the article number changing key 75 is operated in step ST18, the control portion 140 causes the display 121 to display the article number input screen 70. Then, if numerical data is input by use of the numeric keypad 72 and input determination key 73, the control portion 140 fetches the numerical data as the article number data A.

Next, the control portion 140 compares the article number data A with the count of the addition counter B. That is, it compares the number A of dishes 4 input via the numerical data input portion with the number B of dish RFID tags 6*a* from which information is read by the RFID tag reader 150. As a result, when the number A coincides with the number B, the control portion 140 performs the settlement process.

When the manual input key 74 is operated in step ST19, the control portion 140 performs the manual input process in step ST20. The procedure of the manual input process is concretely shown in the flowchart of FIG. 7.

First, the control portion 140 causes the display 121 to display a manual input screen 90. One example of the manual input screen 90 is shown in FIG. 10. On the manual input screen 90, a plurality of menu keys 91, preceding-page key 92, succeeding-page key 93 and input determination key 94 are displayed. Menu codes of various types of menu articles are allocated to the respective menu keys 91.

The user inputs each menu key 91 corresponding to a dish 4 from which the dish RFID tag 6*a* was not read for each article. Then, when all of the corresponding menu keys 91 are input, the input determination key 94 is operated.

When the menu key 91 is operated, the control portion 140 retrieves the menu file 161 by use of a menu code allocated to the menu key 91. Then, it reads out menu data corresponding to the menu name, price and the like and stores the readout menu data into the work area. Further, it counts up the addition counter B by "1".

When the input determination key 94 is operated, the control portion 140 compares the article number data A with the count of the addition counter B. That is, it compares the number A of dishes 4 with the number B of menu articles B. As a result, when the number A coincides with the number B, the control portion 140 performs the settlement process.

Figure 6:
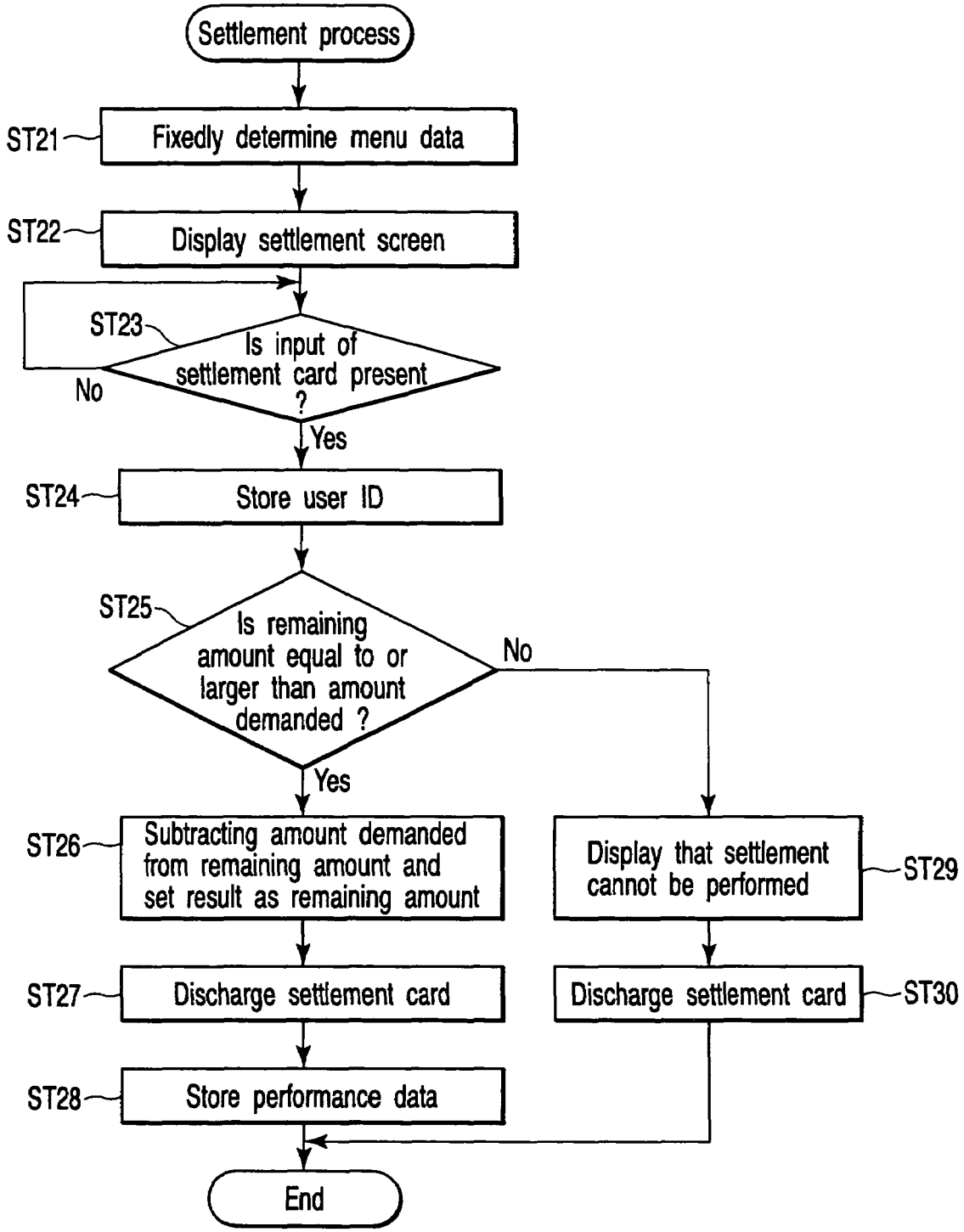
FIG. 6 is a flowchart for illustrating a concrete procedure of a settlement process in FIG. 5.
Figure 7:
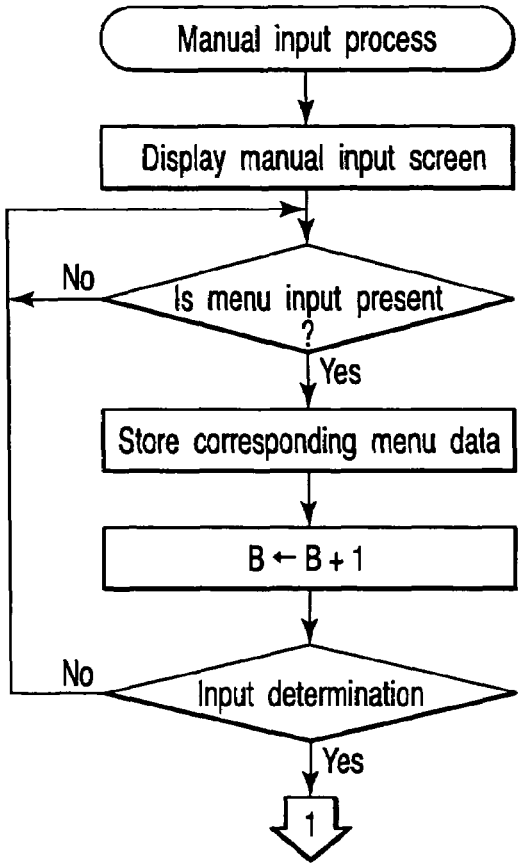
FIG. 7 is a flowchart for illustrating a concrete procedure of a manual input process in FIG. 5.

FIG. 6 is a flowchart concretely showing the processing procedure of the settlement process. The control portion 140 determines all of the menu data items stored in the work area in step ST21. Then, it supplies the menu data to the sales data processing portion 2. In the sales data processing portion 2, the total sum of amounts of menu articles ordered by the user is calculated based on the menu data transmitted from the RFID tag recognizing portion 1.

The control portion 140 causes the display 121 to display the settlement screen in step ST22. Then, it displays the total sum amount calculated in the sales data processing portion 2 as an amount demanded on the screen. After this, it waits in step ST23 until data of a settlement card is input.

When data of the settlement card is input via the card reader/writer 124, the control portion 140 temporarily stores user ID of the card data into the work area in step ST24. Further, it compares the remaining amount data of the card data with the amount demanded in step ST25.

When the remaining amount data is larger than the amount demanded, the control portion 140 rewrites the remaining amount data of the settlement card into an amount obtained by subtracting the amount demanded from the above remaining amount in step ST26. After this, the control portion 140 discharges the settlement card from the card reader/writer 124 in step ST27. Further, it forms performance data of utilization of the dining hall based on the user ID, tray number and each menu data stored in the work area in step ST28. The utilization performance data is written into the performance file 162. Thus, the settlement process is terminated.

If the remaining amount data is deficient for the amount demanded, the control portion 140 causes the display to display an error screen indicating that the settlement process cannot be performed in step ST29. Further, it discharges the settlement card from the card reader/writer 124 in step ST30. Thus, the settlement process is terminated.

When the settlement process cannot be performed because the remaining amount is deficient, the case can be coped with by performing the settlement process again after increasing the remaining amount data or paying a deficient amount in cash to make up the balance.

In the dining hall in which the article sales data processing apparatus of the present embodiment is introduced, the user places a tray 5 on the tray plate 111 of the RFID tag recognizing portion 1 after placing all of the dishes 4 of menu articles ordered on the tray 5.

Then, the RFID tag reader 150 is first operated to read data, that is, the tray number and the like of the tray RFID tag 6*b* attached to the tray 5. Next, the CCD camera 131 is operated to photograph an image of the tray 5. Then, the image data is processed and the number of dishes 4 placed on the tray 5 is counted.

After this, the RFID tag reader 150 is operated again to read data, that is, the menu codes and the like of the dish RFID tags 6*a* attached to the dishes 4 placed on the tray 5. Then, menu data such as the article name, price set in correspondence to the menu code is read out from the menu file 161. Further, the number B of dish RFID tags 6*a* from which data is read out is counted.

Next, the number A of dishes 4 is compared with the number B of dish RFID tags 6*a*. If the number A coincides with the number B, the menu data is determined. If the menu data is determined, article sales data is processed based on the thus determined menu data. Then, an amount demanded is calculated.

If the number B is larger than the number A, the article number input screen 70 is displayed. At this time, the user inputs the number of dishes 4 placed on the tray 5 by use of the numeric keypad 72 and operates the input determination key 73. Thus, the number A becomes equal to the number B. As a result, the menu data is determined and an amount demanded is calculated.

If the number B is smaller than the number A, the tag read error screen 80 is displayed. The user specifies the dish 4 from which the dish RFID tag 6*a* is not read based on the contents of the screen 80. Then, the user operates the menu key 91 of the corresponding menu article after displaying the manual input screen 90 by operating the manual input key 84. Thus, menu data of the menu article is read out from the menu file 161. Further, the addition counter B is counted up.

The user inputs the input determination key 94 after inputting all of the corresponding menu keys 91. Thus, the number A becomes equal to the number B. As a result, menu data is determined and an amount demanded is calculated.

As described above, according to the present embodiment, only when the number B of dish RFID tags 6*a* from which data is read coincides with the number A of dishes 4 placed on the tray 5, data of menu articles ordered by the user is determined. Then, the article sales data process is performed based on the menu data.

In other words, when even one dish 4 to which a dish RFID tag 6*a* whose data is not read is attached is placed on the tray 5, menu data of all of the menu articles ordered by the user is not determined. Therefore, the reliability of the tag recognition operation can be enhanced.

Further, it is not necessary for the user to determine whether or not a dish RFID tag 6*a* from which data is not read is present. Therefore, the operability of the tag recognition operation can be enhanced.

In the present embodiment, the number of dishes 4 is automatically counted by use of the image processing technique. Therefore, a self-accounting process can be performed and the labor cost can be reduced.

Further, the number of dishes may be manually input from the beginning by displaying the article number input screen 70 as the initial screen of the RFID tag recognizing portion 1. In this case, it is possible to omit the CCD camera 131 and image processing portion 132.

The above configuration may be applied to a check out system in a supermarket or the like, for example. In the system, an RFID tag is attached to each article. In a memory of the RFID tag, article information items such as identification codes of articles to which the tags are respectively attached is stored. The RFID tag reader is mounted on the article placing portion.

The customer puts articles to be purchased on the article placing portion. The cashier manually inputs the number of articles placed on the article placing portion. When the manually input article number coincides with the number of RFID tags read by the RFID tag reader, article information of the RFID tag is determined. Then, article sales data is processed based on the article information. Thus, the check out process for articles to which the RFID tags are attached can be correctly performed.

In this case, the manually input number of articles is displayed on a large scale so as to be clearly seen from the distance. Thus, it is possible to attain the effect that the dishonest behavior of inputting the number of articles which is less than the actual article number is suppressed. Therefore, it can be introduced into the self-accounting system.

Further, this invention is not limited to the article sales data processing apparatus. For example, this invention can be applied to a handy terminal with an RFID tag reader or the like which is used to perform the stocktaking operations.

In this case, the person in charge of the stocktaking operations counts and manually inputs the number of articles placed on the shelf. Further, he operates the RFID tag reader of the handy terminal to read article information of RFID tags respectively attached to the articles on the shelf.

In the handy terminal, the number of RFID tags from which article information is read is compared with the manually input article number. Then, if coincidence occurs, the stocktaking operation is settled and a list of articles in stock is output. Thus, it becomes possible to previously prevent occurrence of a problem that an article is removed from the list of articles in stock because the RFID tag thereof is damaged.

Further, in the above embodiment, data of the RFID tag 6 attached to the article is read by operating the RFID tag reader 150 after the number of articles is fetched. However, the number of articles can be fetched and compared after data of the RFID tag 6 is read.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An RFID tag recognizing apparatus which recognizes storage information of RFID tags attached to respective articles, comprising:

an antenna which performs radio-communication with the RFID tags, a reading portion which reads storage information of RFID tags lying in a communication area of the antenna, a tag counting portion which counts the number of RFID tags from which storage information is read by the reading portion, an article number acquiring portion which acquires the number of articles lying in the communication area of the antenna, a comparing portion which compares the number of articles acquired by the article number acquiring portion with the number of RFID tags counted by the tag counting portion, and a processing portion which determines the storage information of the RFID tags read by the reading portion when the number of articles acquired by the article number acquiring portion coincides with the number of RFID tags counted by the tag counting portion as a result of the comparison by the comparing portion.

2. The RFID tag recognizing apparatus according to claim 1, wherein the processing portion informs an error when the number of articles acquired by the article number acquiring portion does not coincide with the number of RFID tags counted by the tag counting portion.

3. The RFID tag recognizing apparatus according to claim 1, further comprising an input portion which inputs numerical data, wherein the article number acquiring portion acquires numerical data input via the input portion as the number of articles.

4. The RFID tag recognizing apparatus according to claim 1, further comprising a photographing portion which photographs the articles lying in the communication area of the antenna, wherein the article number acquiring portion includes an article determining portion which determines the articles based on image data photographed by the photographing portion and an article counting portion which counts the number of articles determined by the article determining portion.

5. The RFID tag recognizing apparatus according to claim 4, further comprising an input portion which inputs numerical data, wherein the processing portion informs an operation of waiting for input of numerical data when the number of RFID tags counted by the tag counting portion is larger than the number of articles counted by the article counting portion and the article number acquiring portion acquires numerical data input via the input portion as the number of articles after the operation of waiting for input of the numerical data is informed.

6. The RFID tag recognizing apparatus according to claim 1, wherein the processing portion informs a difference between the number of articles acquired by the article number acquiring portion and the number of RFID tags counted by the tag counting portion as a deficient number when the number of RFID tags is smaller than the number of articles.

7. An article sales data processing apparatus which processes article sales data based on storage information of RFID tags attached to respective articles, comprising:

an antenna which performs radio-communication with the RFID tags, a reading portion which reads storage information of RFID tags lying in a communication area of the antenna, a tag counting portion which counts the number of RFID tags from which storage information is read by the reading portion, an article number acquiring portion which acquires the number of articles lying in the communication area of the antenna, a comparing portion which compares the number of articles acquired by the article number acquiring portion with the number of RFID tags counted by the tag counting portion, and a processing portion which determines the storage information of the RFID tags read by the reading portion when the number of articles acquired by the article number acquiring portion coincides with the number of RFID tags counted by the tag counting portion.

8. The article sales data processing apparatus according to claim 7, further comprising an informing portion which informs an error when the number of articles acquired by the article number acquiring portion does not coincide with the number of RFID tags counted by the tag counting portion.

9. The article sales data processing apparatus according to claim 7, further comprising a photographing portion which photographs the articles lying in the communication area of the antenna, wherein the article number acquiring portion includes an article determining portion which determines the articles based on image data photographed by the photographing portion and an article counting portion which counts the number of articles determined by the determining portion.

10. The article sales data processing apparatus according to claim 9, further comprising an input portion which inputs numerical data, wherein the processing portion informs an operation of waiting for input of the article number when the number of RFID tags counted by the tag counting portion is larger than the number of articles counted by the article counting portion and the article number acquiring portion acquires numerical data input via the input portion as the number of articles after the operation of waiting for input of the article number is informed.

11. The article sales data processing apparatus according to claim 7, further comprising a display portion which displays article data, wherein the processing portion causes the display portion to display a deficient portion as a vacant space when the number of RFID tags counted by the tag counting portion is smaller than the number of articles acquired by the article number acquiring portion.

12. The article sales data processing apparatus according to claim 7, further comprising a display portion which displays article data, wherein the processing portion causes the display portion to display boxes of a number corresponding to the number of articles acquired by the article number acquiring portion and sequentially display article names of the articles to which the RFID tags whose storage information is read by the reading portion are attached in the respective display boxes when the number of RFID tags counted by the tag counting portion is smaller than the number of articles acquired by the article number acquiring portion.

13. An RFID tag recognizing method which recognizes storage information of RFID tags attached to respective articles, comprising:

reading storage information of RFID tags lying in a communication area of an antenna which performs radio-communication with the RFID tags, counting the number of RFID tags from which storage information is read, acquiring the number of articles lying in the communication area of the antenna, comparing the number of articles with the number of RFID tags, and determining the storage information of the RFID tags read when the number of articles coincides with the number of RFID tags and informs an error when the number of articles does not coincide with the number of RFID tags.

* * * * *